United States Patent [19]

Alix

[11] 3,956,987

[45] May 18, 1976

[54] MEANS FOR CLEANING SUCTION AIR CONDUITS ON PRINTING PRESSES

[75] Inventor: Hans Alix, Offenbach, Germany

[73] Assignee: Roland Offsetmaschinenfabrik Faber & Schleicher AG, Germany

[22] Filed: Sept. 30, 1974

[21] Appl. No.: 510,468

[30] Foreign Application Priority Data

Oct. 3, 1973 Germany ..... 2349557

[52] U.S. Cl. ..... 101/425

[51] Int. Cl.[2] ..... B41F 35/00

[58] Field of Search ..... 74/219; 101/425, 423; 131/244; 138/40; 271/90, 98, 108

[56] References Cited

UNITED STATES PATENTS

| | | | |
|---|---|---|---|
| 1,121,700 | 12/1914 | Wiedmann | 138/40 |
| 1,418,145 | 5/1922 | Fischer | 271/108 X |
| 3,217,552 | 11/1965 | Daub | 74/219 |

FOREIGN PATENTS OR APPLICATIONS

| | | | |
|---|---|---|---|
| 620,638 | 10/1935 | Germany | 101/425 |

*Primary Examiner*—Harland S. Skogquist
*Attorney, Agent, or Firm*—Wolfe, Hubbard, Leydig, Voit & Osann, Ltd.

[57] ABSTRACT

A suction system for a printing press having a cycled suction-requiring element serviced by a suction line in a dusty environment. The line includes a suction valve having an operator coupled to the press drive and which is cyclically opened and closed to define active suction intervals separated by idle intervals. A source of pressurized air is connected, via a pressure valve, to the suction line. A pressure valve operator, also coupled to the press drive, opens the pressure valve momentarily during an idle interval following each predetermined number of operations of the suction valve, so that the suction line is cyclically cleaned by reverse shot of pressurized air without interfering with the function performed by the suction. In the preferred embodiment the suction valve operator is coupled to the pressure valve operator through an integral step down driving connection.

1 Claim, 3 Drawing Figures

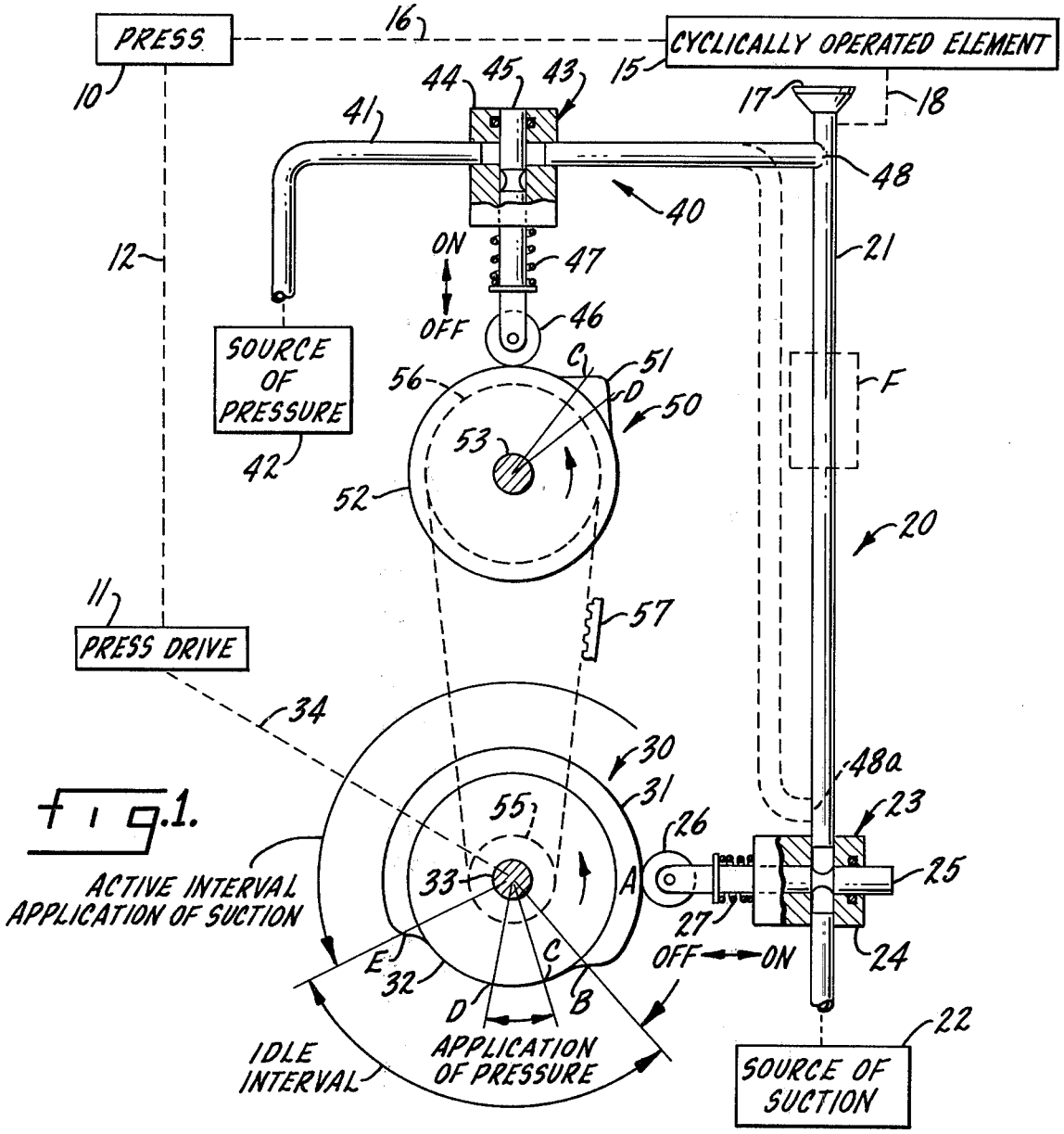
fig.1.
fig.2.
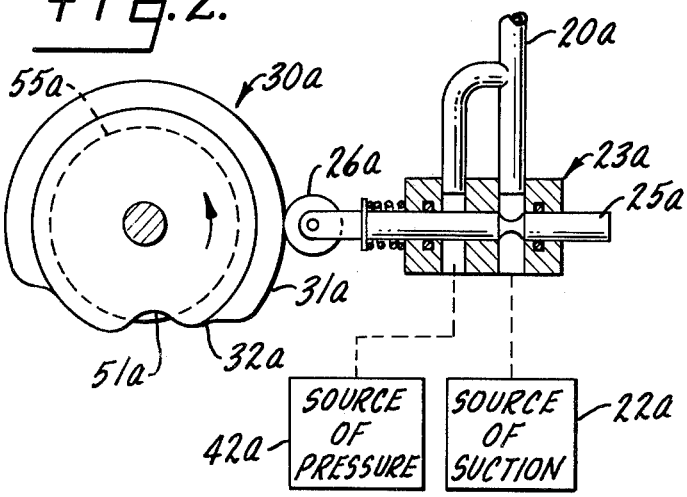
fig.3.
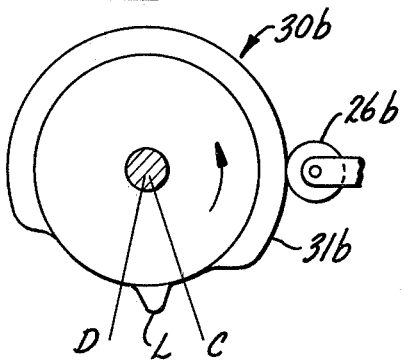

MEANS FOR CLEANING SUCTION AIR CONDUITS ON PRINTING PRESSES

Suction is used to perform a number of functions in a sheet fed lithograph press, but primarily the actuation of suction cups which are mounted upon a cyclically moving element to achieve separation and transfer, or conveyance, of individual sheets. Since the atmosphere in the press room is normally laden with paper dust and ink mist, it usually does not take very long for the suction lines to become partly or completely blocked by foreign matter. The effect is to cause erratic operation and failure of the sheet transfer means requiring shutdown of the press. Indeed, failure of timed transfer of a sheet not only interrupts production but may initiate a hazardous or jamming condition. Keeping the suction lines clear by regular maintenance procedures is difficult and time consuming.

Accordingly, it is an object of the present invention to provide novel means for preventing the clogging of a suction line by paper dust or the like by subjecting the line periodically to a shot of pressurized air in the reverse direction, thereby correcting an incipient clogging condition before clogging has had opportunity to occur. It is a related object to provide means for subjecting a suction line to a reverse shot of air during an idle interval in a suction cycle thereby precluding interference with the function that the suction is intended to perform.

It is another object of the present invention to provide valves and respective operators controlling suction and pressure and in which the operators are coupled together through an integral step down drive connection so that the suction line is subjected to a shot of pressurized air in the reverse direction on an occasional basis, that is, during an idle interval between a predetermined number of applications of suction.

It is yet another object of the invention to provide a cleaning arrangement for the suction lines in a printing press which is simple, inexpensive and foolproof and which can be added at minor expense to existing designs of new presses and, indeed, as an attachment to presses already in the field.

Other objects and advantages of the invention will become apparent upon reading the attached detailed description and upon reference to the drawing in which:

FIG. 1 is a diagram showing a suction line cleaning arrangement in accordance with the present invention;

FIG. 2 is a diagram illustrating a modified form of the invention utilizing a double throw valve; and FIG. 3 shows a modified cam profile for use in the system of FIG. 1.

While the invention has been described in connection with a preferred embodiment, it will be understood that I do not intend to be limited to the particular embodiment shown but intend, on the contrary, to cover the various alternative and equivalent constructions which may be included within the spirit and scope of the appended claims.

Turning now to FIG. 1 there is disclosed, in diagrammatic form, a press with an associated suction system constructed in accordance with the invention. The press, indicated generally at 10, has the usual press drive 11 and drive connection 12. The press includes a cyclically operated element 15 having a drive connection 16. Associated with the cyclically operated element is a suction cup or "head" 17 open to ambient air. In a practical press the cyclically operated element 15 may, for example, be a mechanically reciprocated arm upon which the suction head 17 is mounted, by a connection 18, so as to periodically engage the suction head to a sheet for the purpose of separating the sheet from similar sheets and/or for the purpose of transforming or conveying the sheet from one position to the next in the path of sheet flow, reference being made to the art relating to sheet transfer devices.

For the purpose of applying suction to the head 17 on a cyclical basis, a suction system 20 is provided including a suction line 21 which is coupled to a remote source of suction 22 by means of a suction valve 23. A typical valve 23 consists of a valve body 24 having a transverse bore occupied by a sliding spool 25. The spool has a cam follower 26 at one end with a return spring 27. The cam follower rides upon a valve operator in the form of a cam 30 having a "high" region 31 which defines the active interval during which suction is applied and a "low" region 32 which defines the idle interval during which there is no suction. The cam 30 has a cam shaft 33 which is coupled via a drive connection 34 to the press drive 11.

It will be apparent that since the cyclically operated element, or arm, 15 which carries the suction head 17, and the cam 30, or the shaft 33 which mounts the cam 30, are both connected to the same press drive 11, the application of suction can be synchronized with the movement of the element 15 by the simple expedient of adjusting the phase position of the cam 30 with respect to the drive. Thus in the exemplary embodiment suction is applied to the suction head timed with the engagement between the suction head and the sheet which is to be separated or transferred, with the suction being turned off to secure release of the sheet to begin the idle portion of the cylce during which the suction head is not within range of any sheet.

In accordance with the present invention a source of pressure is coupled to the suction line via a pressure valve, and an operator is provided for the pressure valve having an integral drive connection with the operator for the suction valve so that the suction line is subjected to a shot of pressurized air timed with an idle interval to cyclically clean the suction line without interfering with the function that the suction is intended to perform. Thus referring again to the drawing there is provided an auxiliary pressure system 40 having a pressure line 41 and connected to a source of pressure 42. Interposed in the pressure line is a pressure valve 43 having a body 44 and spool 45. The spool is coupled to a cam follower 46 having an associated return spring 47. The end of the pressure line 41 is connected to the suction line 21 at a joint 48.

For the purpose of cyclically opening the pressure valve timed with an idle interval of the suction valve, a cam 50 is provided having a high point 51 and a low region 52, the cam being mounted upon a shaft 53. For the purpose of limiting application of pressurized air to an integral number of applications of suction, an integral step down drive connection is provided between the cam 30 and cam 50. Such step down drive connection in the present instance takes the form of a first drive pulley 55 and a second drive pulley 56, on the respective cams, or cam shafts, and which are interconnected by a drive belt 57.

The drive belt is preferably of the timing or "cog belt" type, with the pulleys similarly cogged, to preserve an accurate phase relation between the two cams. In the illustrated embodiment the pulley 55 is one half of the diameter of the pulley 56, thus providing a step down drive ratio of 2:1, that is, the cam 50 turns through one revolution for each two revolutions of the cam 30. It will be understood that the illustrated drive connection is for exemplary purposes only and the belt may be replaced by a light timing chain or, if desired, gears may be interposed between the cams, e.g., in a 2:1 ratio.

The coordination between the application of suction and the application of reversely flowing pressurized air will be apparent upon considering a two-rotation cycle of the cam 30. It will be understood that both the cams rotate in the direction of the arrows. At the outset, with cam 30 at point A, which may be taken as a reference position, the suction valve 23 is open so that suction is applied to the head 17, while the pressure valve 43 is closed. Upon continued rotation of the cam 30 the point of drop-off, B, is reached to turn off the suction. Shortly thereafter, after the head 17 has had opportunity to release the sheet which it engages so that it is no longer within range of a sheet, and during the indicated "idle interval", point C is reached corresponding to the opening of pressure valve 43 which admits a shot of pressurized air from the source 42 to the suction line 21, the air flowing outwardly from the head 17, that is, in the direction opposite to the normal suction flow, and with a velocity determined by the pressure of the source. Preferably the source pressure is much stronger than the vacuum. Indeed, the pressure may be so adjusted as to produce a shot of air of explosive velocity, limited only by sonic considerations. Normally, however, moderate pressure on the order of a few pounds per square inch will suffice to eliminate any incipient collection of dust.

As point D of the cycle is reached, the pressure valve is closed, and no air flow takes place until point E where the cam 30 again throws the spool of the suction valve 23 for reapplication of suction to the head. Suction persists until point A again is reached to complete a single rotation of cam 30. However, because of the 2:1 step down, the next rotation of cam 30 takes place without any application of air pressure thereby to complete a second revolution which completes a single operating cycle. It is not considered that application of a shot of pressurized air is necessary following each application of suction. Indeed, the step-down drive connection which couples the cams 30, 50 instead of having a 2:1 ratio, may have a ratio in any convenient integral number, the only limitation being that the pressurized air shall be turned on and turned off in an idle interval which separates an integral number of applications of suction.

While the pressure connection 48 is shown connected to suction line 21 at a point reasonably close to the suction head 17, it will be understood that the connection may be made at a point 48a remote from the head and which, indeed, may be closely adjacent the suction valve 23. In this way practically the entire length of the suction line is acted upon the reverse flow of pressurized air. It is found that flowing the pressurized air in a direction opposite the suction flow is much more effective, for cleaning purposes, than the same amount and velocity of air flowing in the suction direction.

Where it is desired to dispense with the integral drive connection and to provide a shot of pressurized air on a 1:1 basis with respect to the applications of suction, the system may be simplified by combining the functions of the valves 23, 43 in a single valve of the double throw type. Thus referring to FIG. 2, in which corresponding parts are indicated by corresponding reference numerals, with addition of subscript *a*, the suction line 20*a* has a valve 23*a* which is connected to sources of suction and pressure 22*a*, 42*a*, respectively. Slideable in the valve 23*a* is a plunger 25*a* having a follower 26*a* which rides upon cam 30*a*. In addition to having a "high" region 31*a* and reference region 32*a*, the cam has a narrow "low" region 51*a* which corresponds, in function, to the lobe 51 on the cam 50 of the previous embodiment. It will be apparent when the cam rotates in the direction of the arrow a first position of drop-off will be reached which will be effective to shut off the suction to begin an idle interval. During the idle interval a second point of drop-off is encountered as the follower 26*a* moves into the "low" point 51*a* causing a shot of pressurized air to be applied to the suction line 20*a*. Continued rotation of the cam restores the follower to reference position, following which the follower is again thrust to the right for reapplication of suction to the line.

It will be apparent that either the arrangement shown in FIG. 1 or that shown in FIG. 2 is capable of clearing the entire suction line. If desired even the suction valve may be subjected to a shot of air by cracking it open momentarily timed with application of pressurized air. This can be accomplished, as shown in FIG. 3, in which corresponding elements have received corresponding numerals with the addition of subscript *b*. Thus, mounted on the periphery of cam 30*b* is auxiliary lobe L positioned to lie midway between the points C, D and preferably sharply formed and of shallow height so that the volume of air reversely flowing through the suction valve will not be so great as to spoil the suction.

The present suction system amply meets the objects set forth above. It is found that even a brief shot of air, timed with the idle interval, is capable of keeping the suction line and suction head completely clear of accumulated paper dust and the like, aggravated by ink mist, even under the most severe conditions and for an extended period of time so that there is no necessity for any regular regimen of line maintenance. While the invention has been described in connection with a suction head 17 inteneded for the purpose of engaging and releasing sheets, it will be understood that the term "head" covers any aspirating element open to the ambient air and that the invention is equally applicable to any cycling type suction system used in a contaminated atmosphere regardless of the nature of the suction-requiring element. The term "line" is intended to cover any conduit regardless of length.

It is one of the features of the invention that it may be used for the periodic back-flushing of dust filters included in the system. Thus where a porous dust filter F is used in the line between the valve and the head and where the pressure connection is made adjacent the valve (as at 48*a*) the filter as well as the line 20 is blown clear each time pressure is applied, constantly renewing the filter element and making the usual periodic replacement or cleaning unnecessary.

What is claimed is:

1. In a suction system for a printing press having a dusty environment, the combination comprising a press drive for driving a press including a cyclically operated suction-requiring element, a suction line, a source of suction at one end of the line, a suction head at the other end of the line open to ambient air and associated with the suction requiring element, a suction valve interposed between the source of suction and the suction line, a suction valve operator coupled to the press drive for cyclically opening the suction valve for applying suction at the element during active intervals and for closing the suction valve during intervening idle intervals, a pressure line, a source of high pressure air at one end of the pressure line, the other end of the pressure line being connected to the suction line, a pressure valve interposed between the source of pressure and the pressure line, a pressure valve operator, and an integral step-down drive connection connected between the suction valve operator and the pressure valve operator for opening the pressure valve momentarily to provide a high velocity reversely flowing shot of air well within the idle interval between a predetermined integral number of active intervals of the suction valve.

* * * * *